US005970528A

United States Patent [19]

Shirai et al.

[11] Patent Number: 5,970,528

[45] Date of Patent: Oct. 26, 1999

[54] WARM-WATER WASHING DEVICE

[75] Inventors: Shigeru Shirai, Tsuge-mura; Hiroaki Yoshida, Yamatokoriyama, both of Japan

[73] Assignee: Matsushita Electric Industrial Co., Ltd., Osaka, Japan

[21] Appl. No.: 08/793,904

[22] PCT Filed: Jul. 8, 1996

[86] PCT No.: PCT/JP96/01892

§ 371 Date: May 23, 1997

§ 102(e) Date: May 23, 1997

[87] PCT Pub. No.: WO97/03255

PCT Pub. Date: Jan. 30, 1997

[30] Foreign Application Priority Data

Jul. 7, 1995 [JP] Japan ..... 7-171834

[51] Int. Cl.[6] ..... E03D 9/08

[52] U.S. Cl. ..... 4/420.2; 4/420.4

[58] Field of Search ..... 4/420.2, 420.4

[56] References Cited

U.S. PATENT DOCUMENTS 4,192,023 3/1980 McComb ..... 4/420.2 X

FOREIGN PATENT DOCUMENTS 61-26776 2/1986 Japan .
62-28249 6/1987 Japan .
63-42299 3/1988 Japan .
6-46074 6/1994 Japan .
6306915 11/1994 Japan ..... 4/420.2

OTHER PUBLICATIONS

English Abstract of JP–63–42299.
English Abstract of JP 6–46074.
English Abstract of JP 62–28249.
English Abstract of JP 61–26776.

*Primary Examiner*—Robert M. Fetsuga
*Attorney, Agent, or Firm*—Ratner & Prestia

[57] ABSTRACT

The present invention relates to a warm water washing device for washing a human body and aims to pasteurize an inside of a water flowing route which is difficult to clean and keep the device hygienic without an outbreak of pollution due to fungi and molds. A warm water washing device according to the present invention provides with a discharge nozzle 22 for discharging warm water for washing a human body and pasteurization control means 34 for controlling the function to pasteurize the discharge nozzle 22 and a hot water course 23 to discharge nozzle 22.

39 Claims, 4 Drawing Sheets

WARM-WATER WASHING DEVICE

This application is the U.S. national-phase application of PCT International Application No. PCT/JP96/01892.

FIELD OF THE INVENTION

The present invention relates to a warm water washing device for washing a human body with warm water.

BACKGROUND OF THE INVENTION

As such a kind of warm water washing device, there is a device shown in FIG. 8, for example, Utility Model Laid-Open 61-26776.

In FIG. 8, the block 1 is a feedwater tank and water is sucked by a pump 2 and is fed to a branch point 4 through a feed pipe 3. A part of the water branched at branch point 4 is supplied to a mixing chamber 13 after passing through a bypass pipe 5 and a mixing device 12 providing with a valve 11 driven by a stepping motor 10 and the other part of the water branched at branch point 4 is also supplied to mixing chamber 13 after passing through a hot water tank 8 providing with a heater 6 and a tank temperature detector 7 and further passing through a hot water feed pipe 14. In the mixing chamber 13, a temperature detector 15 is provided to detect the temperature of the mixed water and the flow rate passing through pipe 5 is controlled here by stepping motor 10 and valve 11 so that the detected temperature becomes a designated temperature. Thus, the temperature of the warm water supplied to a washing nozzle 16 is controlled.

In recent years, living environment is improved and the variation of temperature and humidity inside the room during a year is small. Especially, it is remarkable at a toilet. Because a hygienic washing toilet seat device which is recently spreading in the market provides with a heated toilet seat and a water jet nozzle, the toilet seat device is kept in high temperature and high humidity. Therefore, pollution and slime sometimes occur at the toilet device and its accessory parts due to growth of molds and bacteria (for example, colon bacillus, legionelae, etc.) and it is easy to be unhygienic. The pollution has been washed and cleaned with bleach such as chlorine group and alcoholic group or detergent.

However, what can be cleaned by detergent is only an outerior part of the toilet seat device and it is difficult to clean a part forming a water flowing route inside the toilet seat device. There is a problem that if such pollution is left for a long time, the part forming a water flowing route deteriorates and is unclean. In the warm water washing device of the prior art described above, the temperature of the water flowing route from mixing chamber 13 of mixing device 12 to washing nozzle 16 is about 40 degrees centigrade or normal temperature. This is a temperature that molds and bacteria are easy to grow and excretory organ of the human body is supposed to be washed with warm water passing through a polluted water flowing route.

SUMMARY OF THE INVENTION

The present invention is to solve the above problem and aims to present a warm water washing device which pollution due to molds and fungi does not outbreak in its parts even if it is used for a long time, is hygienic and especially keeps the inside of the water flowing route which is difficult to clean in a hygienic condition.

To achieve the above object, a warm water washing device in accordance with a first invention includes:

a discharge nozzle to discharge warm water for washing a human body; and pasteurization means for directly or indirectly pasteurizing at high temperature at least a part of the discharge nozzle and the warm water course to the discharge nozzle.

A warm water washing device in accordance with a second invention is what the pasteurization means in the first exemplary embodiment provide with pasteurization control means to control the working of pasteurization by receiving a pasteurization mode signal.

A warm water washing device in accordance with a third invention is what pasteurizes using high temperature air in the first or second invention.

A warm water washing device in accordance with a fourth invention is what pasteurizes using high temperature water in the first or second invention.

A warm water washing device in accordance with a fifth invention includes:

heating means;

a feed pipe connected to the heating means;

a mixing valve for controlling the mixing rate of water from the feed pipe and the hot water heated by the heating means;

a discharge nozzle connected to the mixing valve; and pasteurization control means for controlling the working to pasteurize the discharge nozzle and the warm water course to the discharge nozzle by hot water supplied from the mixing valve.

A warm water washing device in accordance with a sixth invention includes:

heating means;

a hot water temperature detector for detecting the temperature of hot water heated by the heating means;

heating temperature control means for controlling the temperature of the water heated by the heating means;

a feed pipe connected to the heating means;

a bypass pipe branching off from the feed pipe and not passing through the heating means;

a mixing valve providing with electrical drive means for controlling the mixing ratio of the water from the feed pipe and the hot water heated by the heating means;

a hot water course where a hot water outgoing pipe connected to the heating means and the bypass pipe join together;

discharge nozzles connected to the hot water course;

a mixing temperature detector for detecting the temperature of the hot water which is down stream of the mixing valve;

a setting button unit for setting the temperature of the hot water flowing in the hot water course;

a mixing temperature control means for controlling the mixing valve by comparing the temperature detected by the mixing temperature detector with the temperature set by the setting button unit; and pasteurization means for controlling pasteurization by the hot water flowing in the discharge nozzle and the hot water course going to the discharge nozzle, according to a pasteurization mode signal.

A warm water washing device in accordance with a seventh invention is what the temperature for pasteurization is set to 55–70 degrees centigrade in either of the first to sixth invention.

A warm water washing device in accordance with a eighth invention is what the pasteurization is automatically done at every designated period in either of the first to sixth invention.

A warm water washing device in accordance with a ninth invention is what the flow rate is controlled so that the jet stream from the discharge nozzle does not hit a human body at pasteurization in either of the first to sixth invention.

A warm water washing device in accordance with a tenth invention is what the discharge quantity is controlled so that the jet stream from the discharge nozzle does not reach a human body at the pasteurization in either of the first to sixth invention.

A warm water washing device in accordance with a eleventh invention is what further includes safety temperature ending means for detecting that the hot water temperature downs to a safety temperature after ending the pasteurization and stopping a pasteurization mode after a designated period.

A warm water washing device in accordance with a twelfth invention is what further includes body detection means for detecting a human body and pasteurization prohibition means for prohibiting the pasteurization while the body detection means detects a human body.

DETAILED DESCRIPTION OF THE INVENTION

Figure 1:
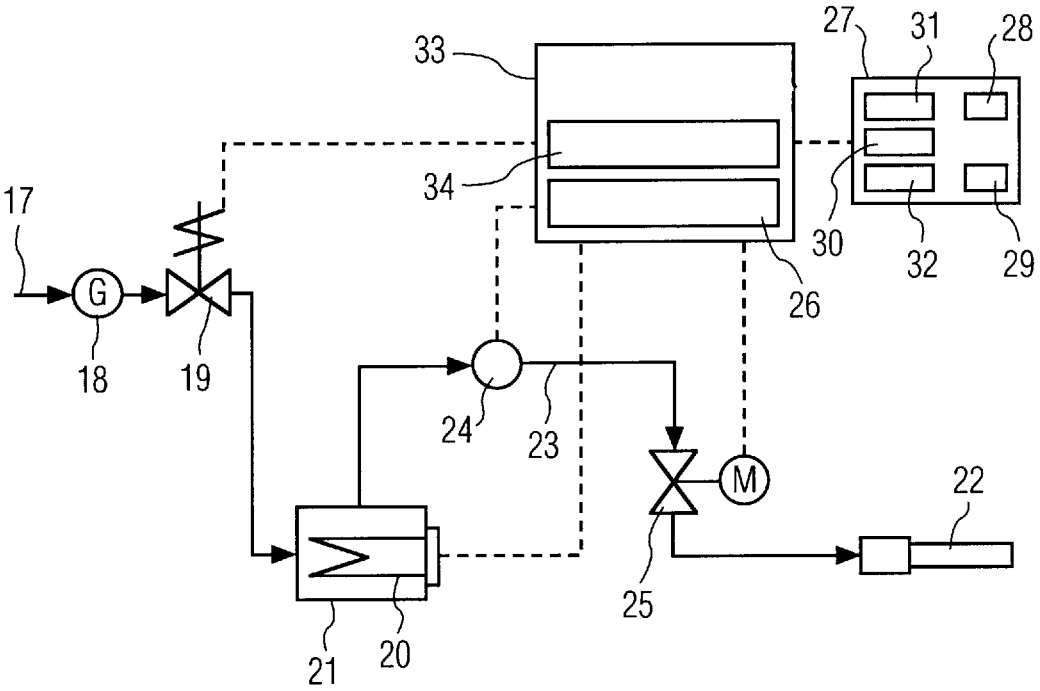
FIG. 1 is a block diagram of a warm water washing device in accordance with a first exemplary embodiment of the present invention.

Exemplary embodiments of the present invention are explained below referring to the drawings.

(First exemplary embodiment)

FIG. 1 is a block diagram of a warm water washing device in accordance with a first exemplary embodiment of the present invention. In FIG. 1, water supplied from a feed pipe 17 is supplied to heating means 21 having a heater 20 after passing through decompression means 18 and a valve 19 for opening and closing a water course. A temperature detector 24 and a flow control valve 25 driven by electric drive means are provided in a hot water course 23 from heating means 21 to a discharge nozzle 22 which discharges warm water for washing a human body. The temperature detector 24 is composed of a thermistor or the like and the electric drive means is composed of a motor or the like.

The temperature of the hot water heated by heater 20 inside heating means 21 is detected by temperature detector 24. Heating temperature control means 26 feedbacks an output signal of temperature detector 24 and controls heater 20 so as to become predetermined temperature.

The operation of the warm water washing device is done by a setting button unit 27. The setting button unit 27 includes a washing switch 28, a stopping switch 29, a temperature setting switch 30, a flow rate setting switch 31 and a pasteurization switch 32. The water temperature for body washing is usually set at about 40 degrees centigrade which is comfortable for a human body through by temperature setting switch 30.

When a washing switch 28 provided in a setting button unit 27 is pushed, the water courses of flow control valve 25 and valve 19 are made open according to a command from a controller 33. Because how wide flow control valve 25 opens is proportional to the flow rate set by flow rate setting switch 31, water with a quantity set by flow rate setting switch 31 spouts from discharge nozzle 22 and washes the body.

When washing finishes, valve 19 is closed according to a command from controller 33 by pushing stopping switch 29 and the washing stops.

When pasteurization switch 32 is pushed, pasteurization control means 34 in controller 33 receives a pasteurization mode signal and drives the electric drive means of flow control valve 25 so that flow control valve 25 limits the flow rate to small and outputs a command signal to heating temperature control means 26 so that the water temperature becomes about 60 degrees centigrade.

The hot water of about 60 degrees centigrade from discharge nozzle 22 becomes as small as dropping off. In this condition, hot water course 23, flow control valve 25 and discharge nozzle 22 inside the water flowing route are pasteurized in high temperature for a designated time. Then, pasteurization control means 34, after outputting a command to heating temperature control means 26 so that the water temperature becomes about 40 degrees centigrade and waiting until warm water of about 40 degrees centigrade begins to discharge from discharge nozzle 22, closes valve 19 and finishes the pasteurization mode.

In a warm water washing device of the prior art, because the water flowing route from mixing chamber 13 of mixing device 12 to washing nozzle 16 is in normal temperature of about 40 degrees centigrade which molds and bacteria are comparatively easy to grow, it is anxious to wash the excretory organ of the body with the warm water coming through the polluted water flowing route.

Thus, according to the first exemplary embodiment of the present invention, a hygienic hot water washing device can be presented, which pasteurizes in high temperature the inside of the water flowing route which is difficult to clean by discharge nozzle 22 which discharges hot water for washing a human body and pasteurization means which pasteurizes in high temperature the discharge nozzle 22 and hot water course 23 to discharge nozzle 22, prevents an outbreak of pollution due to fungi and molds and can wash the human body with clean and warm water.

Because of pasteurization by hot water of high temperature, it is unnecessary to supply chemicals for pasteurization and there is no anxiety of harmful side effects due to residual chemicals.

Further, because heating means 21 can be used in common for a function to make warm water for body washing and for a function to make hot water for pasteurization, above-described pasteurizing effect is realized without increasing the device size and device cost.

(Second exemplary embodiment)

Figure 2:
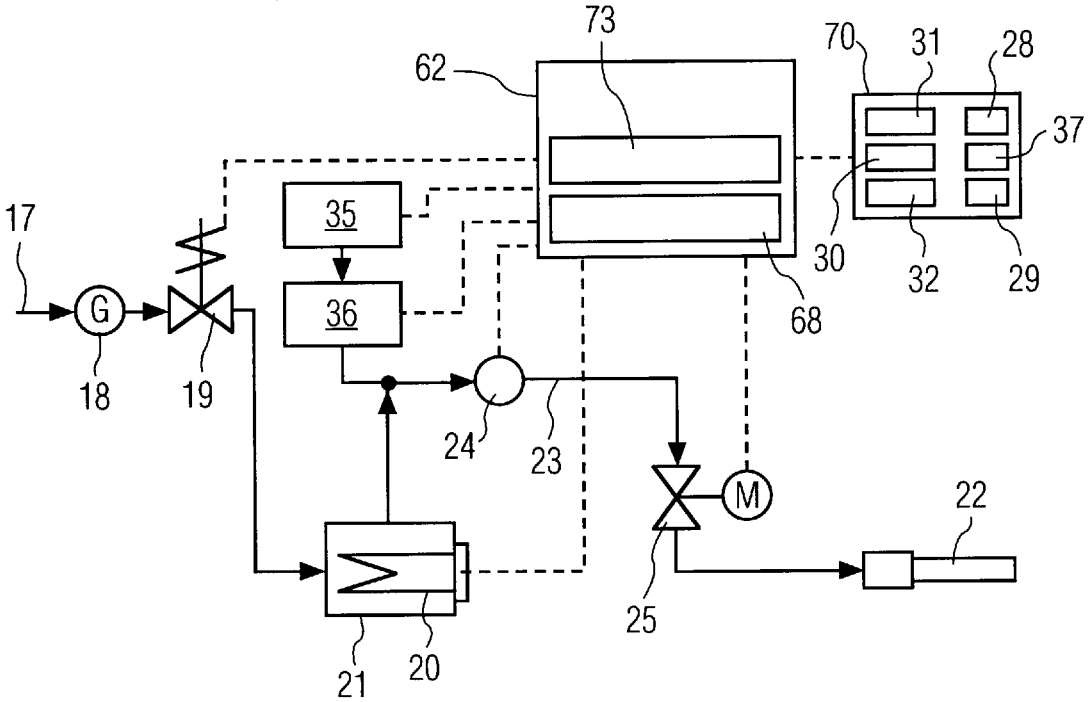
FIG. 2 is a block diagram of a warm water washing device in accordance with a second exemplary embodiment of the present invention.

FIG. 2 is a block diagram of a hot water washing device in accordance with a second exemplary embodiment of the present invention.

The different point from the first exemplary embodiment is that air compression means 35 and air heating means 36 are provided so as to connect to a hot water course 23 and the heated air generated by air compression means 35 and air heating means 36 is made flow out from a discharge nozzle 22 through hot water course 23. The blocks having similar functions to those in the first exemplary embodiment are numbered with the same reference numbers and their explanations are omitted.

When a washing switch 28 provided in a setting button unit 70 is pushed, the water courses of a flow control valve 25 and a valve 19 are made open according to a command from a controller 62. Because how wide flow control valve 25 opens is proportional to the flow rate set by flow rate setting switch 31, water with a quantity set by flow rate setting switch 31 spouts from discharge nozzle 22.

At the same time, because air compression means 35 which is a kind of air pump is also operated, a fluid mixed with hot water heated at heating means 21 and the air from air compression means 35 flows in hot water course 23, spouts from discharge nozzle 22 after passing through temperature detector 24 and flow control valve 25 and washes a human body.

At this usual washing, the output signal of temperature detector 24 is feedbacked to controller 62 and heating temperature control means 68 controls a heater 20 in heating means 21 so as to become a temperature of about 40 degrees centigrade which is preset by a temperature setting switch 30 of setting button unit 70. If the detected temperature at temperature detector 24 is under the desired temperature set by temperature setting switch 30 due to too cool water from feed pipe 17 even if the heating by heater 20 is made maximum, a command from heating temperature control means 68 is sent to air compression means 35 and air heating means 36, air compressed by air compression means 35 is heated by air heating means 36 and is mixed in hot water course 23. Hot water mixed with heated and compressed air spouts from discharge nozzle 22.

Thus, because even hot water with less flow rate gushes out of discharge nozzle 22 and hits the human body, the washing effect is remarkable. Therefore, water can be saved and also electric power for heating the water can be saved. Further, because the flow rate of the used hot water is small, means that hot water necessary for a washing is previously prepared in a tank, that is hot water storing means is not necessary but only means that water is instantaneously heated by heating means 21 can be adopted. Accordingly, the heater temperature can be changed at any time and to any temperature and it can not be realized in hot water storing means. Because a tank for storing hot water is not necessary, the entire size of the washing device can be small.

When washing finishes and stopping switch 20 is pushed, after valve 19 is closed according to a command from controller 62, the compressed and heated air from air compression means 35 and air heating means 36 pushes out the hot water left in hot water course 23 from discharge nozzle 22, that is drains and dries the inside from hot water course 23 to discharge nozzle 22 and the operation stops.

When drying switch 37 in setting button unit 70 is pushed, valve 19 is closed and the heated air from air heating means 36 spouts from discharge nozzle 22 after passing through hot water course 23 as the water and the hot water are kept closed and hits and dries the skin surface of the body. A signal of the the heated air temperature feedbacked from temperature detector 24 to controller 62 heating temperature control means 68 keeps a moderate temperature by controlling sir heating means 36. When stopping switch 29 is pushed, all the operations stop.

Thus, not only washing but also a function to dry the washing part of the body after washing can be provided and because it is not necessary to provide a drying device separately, the entire device can be made small. Further, because hot water route 23 and discharge nozzle 22 are dried after washing operation, outbreak of pollution due to fungi and molds is prevented and hot water course can be kept clean.

When pasteurization switch 32 is pushed, pasteurization control means 73 in a controller 62 receives a pasteurization mode signal and controls air compression means 35 and air heating means 36 so that the hot air spouts from discharge nozzle 22 via hot water course 23 as valve 19 is kept closed. The air temperature is feedbacked from temperature detector 24 to controller 62 and heating temperature control means 68 controls air heating means 36 and keeps the temperature to a suitable temperature for pasteurization. In this condition, the inside of water flowing route such as hot water course 23, flow control valve 25 and discharge nozzle 22 is pasteurized for a designated period. Then, pasteurization control means 73 stops air heating means 36, cools hot water course 23 by using normal temperature air from air compression means 35 and stops a pasteurization mode after the temperature of hot water course 23 downs to a safety temperature.

According to the second exemplary embodiment of the present invention, by heating the air compressed by air compression means 35 by air heating means 36 and mixing in hot water course 23, hot water course 23 and discharge nozzle 22 are pasteurized with hot air and are kept hygienic without pollution due to fungi and molds.

It is considered that when pasteurizing switch 32 is pushed and the hot air is spouting from discharge nozzle 22, discharge nozzle 22 is moved so that the hot jet air from discharge nozzle 22 does not hit a human body and the user does not feel unpleasant.

(Third exemplary embodiment)

Figure 3:
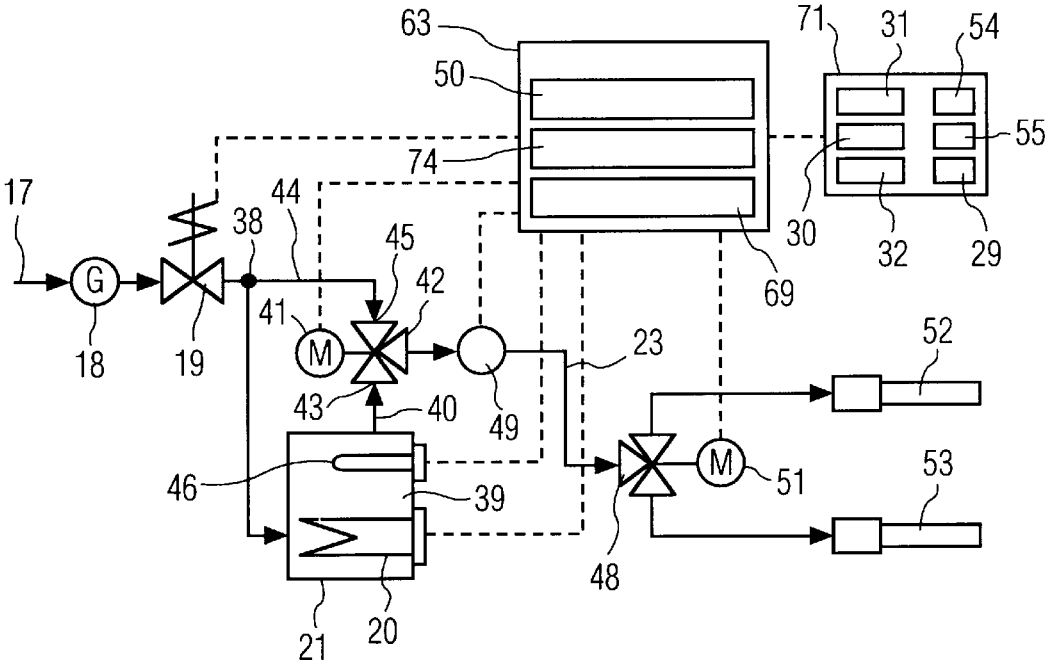
FIG. 3 is a block diagram of a warm water washing device in accordance with third and fourth exemplary embodiments of the present invention.

FIG. 3 is a block diagram of a hot water washing device in accordance with a third exemplary embodiment of the present invention.

In FIG. 3, water supplied from a feed pipe 17 goes to a branch point 38 after passing through decompression means 18 and a valve 19 opening and closing the water course. There are two paths from branch point 38 to a mixing valve 42. One is a path passing through a heating means 21, a hot water outgoing pipe 40 and a hot water inlet 43 of mixing valve 42 and the other is a path passing through a bypass pipe 44 and a water inlet 45 of mixing valve 42. Heating means 21 includes a hot water tank 39 having a heater 20 and mixing valve 42 includes electric drive means 41 composed of a motor. A hot water temperature detector 46 which is made of thermistor and detects a temperature of the hot water heated by heater 20 of heating means 21 is provided in a hot water tank 39 and an output signal from hot water temperature detector 46 is supplied to heating temperature control means 69, which controls heater 20 so that the hot water temperature in tank 39 becomes a preset temperature.

A mixing temperature detector 49 for detecting a hot water temperature is provided in a hot water course 23, which sends warm water mixed at mixing valve 42 with the water in hot water outgoing pipe 40 and the water in bypass pipe 44. Mixing temperature control means 50 adjusts a mixing ratio of mixing valve 42 by comparing the actual temperature detected by mixing temperature detector 49 with the temperature set by a setting button unit 71. At the end of hot water course 23, discharge nozzles 52 and 53 are attached through a flow control valve 48 providing with electric drive means 51 composed of a motor.

Pasteurization control means 74 provided in a controller 63 limits the flow rate to discharge nozzles 52 and 53 by controlling flow control valve 48 according to a pasteurization mode signal from setting button unit 71 and adjusts mixing valve 42 to make the water temperature high. Discharge nozzle 52 is used for washing an anal and discharge nozzle 53 is used for a bidet and they are switched by flow control valve 48.

The operation of the warm water washing device is done by setting button unit 71. Setting button unit 71 includes an anal washing switch 54, a bidet switch 55, a stopping switch 29, a temperature setting switch 30, a flow rate setting switch 31 and a pasteurization switch 32.

When anal washing switch 54 provided in setting button unit 71 is pushed, the hot water courses of flow control valve 48 and mixing valve 19 are made open according to a command from controller 63. Because how wide flow control valve 48 is proportional to the flow rate set by flow rate setting switch 31, the water with a flow rate set by flow rate setting switch 31 spouts from discharge nozzle 52 and at the same time, discharge nozzle 52 is protruded by water pressure.

At this time, the hot water previously boiled up in hot water tank 39 and the water passing through bypass pipe 44 are mixed and the mixing ratio is adjusted by mixing valve 42 so that a temperature detected by mixing temperature detector 49 becomes the temperature set by temperature setting switch 30 of setting button unit 71.

When the washing finishes and stopping switch 29 is pushed, valve 19 is closed according to a command from controller 63 and the washing water stops and flow control valve 48 moves to a stop position. When the supply of washing water is stopped, discharge nozzle 52 for washing an anal is pit away by a spring.

When bidet switch 55 is pushed, discharge nozzle 53 for bidet protrudes and washing is done similar to washing for anal.

When pasteurization switch 32 is pushed, pasteurization control switch 74 in controller 63 stops down the aperture of the valve of mixing valve 42 at the bypass pipe 44 side and opens the valve of mixing valve 42 at the hot water outgoing pipe 40 side by electric drive means 41, receiving a pasteurization mode signal and controls electric drive means 51 so that flow control valve 48 limits the flow rate small. A small quantity of hot water coming from heating means 21 drops off from discharge nozzle 52. At this state, the inside of the water flowing route such as hot water course 23, flow control valve 48 and discharge nozzle 52 is pasteurized for a designated period. Then, a similar action is done also at discharge nozzle 53. After that, pasteurization control switch 74 adjusts the mixing ratio by electric drive means 41 of mixing valve 42 so that the hot water temperature becomes about 40 degrees centigrade and closes valve 19 after warm water of about 40 degrees centigrade is discharged from discharge nozzle 53 and finishes the pasteurization mode.

In a warm water washing device of the prior art, because the temperature of the water flowing route from mixing chamber 13 of mixing device 12 to washing nozzle 16 is about 40 degrees centigrade or normal temperature. This is a temperature that molds and bacteria are easy to grow and excretory organ of the human body is supposed to be washed with warm water passing through a polluted water flowing route.

Thus, according to the third exemplary embodiment of the present invention, the inside of the water flowing route which is difficult to clean is pasteurized and is kept hygienic without pollution due to fungi and molds.

(Fourth exemplary embodiment)

A hot water washing device in accordance with a fourth exemplary embodiment of the present invention is explained referring to FIG. 3, the same as the third exemplary embodiment.

The different point from the third exemplary embodiment is that heating means 21 is controlled by heating temperature control means 69 so that the hot water temperature becomes 55 to 70 degrees centigrade and electric drive means 41 for driving mixing valve 42 is controlled by pasteurization control means 74 so that the detected temperature of a mixing temperature detector 49 becomes 55 to 70 degrees centigrade. That is, the essential point of the fourth exemplary embodiment is that the temperature of pasteurization is set to 55 to 70 degrees centigrade.

Heating temperature control means 69 always controls heater 20, detecting the temperature by hot water temperature detector 46 so that the hot water temperature in hot water tank 39 is kept to 55 to 70 degrees centigrade. Therefore, the inside of hot water tank 39 is always pasteurized at 55 to 70 degrees centigrade and is kept clean and hygienic without growth of molds and bacteria.

When pasteurization switch 32 is pushed, pasteurization control switch 74 stops down the aperture of the valve of mixing valve 42 at the bypass pipe 44 side and opens the valve of mixing valve 42 at the hot water outgoing pipe 40 side by electric drive means 41, receiving a pasteurization mode signal and at the same time controls electric drive means 51 so that flow control valve 48 limits the flow rate small. A small quantity of hot water of 55 to 70 degrees centigrade coming from hot water tank 39 drops off from discharge nozzle 52. At this state, the inside of the water flowing route such as hot water course 23, flow control valve 48 and discharge nozzle 52 is pasteurized for a designated period. Then, a similar action is done also at discharge nozzle 53. After that, pasteurization control switch 74 adjusts the mixing ratio by electric drive means 41 of mixing valve 42 so that the hot water temperature becomes about 40 degrees centigrade and closes valve 19 after warm water of about 40 degrees centigrade is discharged from discharge nozzle 53 and finishes the pasteurization mode.

Thus, according to the fourth exemplary embodiment of the present invention, the inside of the water flowing route which is difficult to clean is pasteurized by hot water of 55 to 70 degrees centigrade and is kept hygienic without pollution due to fungi and molds. Further, there is no anxiety of instantaneous burn even when mixing valve 42 or flow control valve 48 is out of order.

As a temperature for pasteurization, for example in a food field, there are examples that 55–60 degrees centigrade for beer and refined sake about 60 degrees centigrade for miso (fermented soybean paste) and a sufficient pasteurization effect is expectable at 55–70 degrees centigrade. For reference, it is said that the thermal death point of pathogenic bacteria is 60 degrees centigrade for all of dystentery bacillus, typhoid bacillus, paratyphoid bacillus, pathogenic colon bacillus, enteritis vibrio, brucella, streptococcus, staphylococcus and so on and 50 degrees centigrade for pseudomonas acruginosa. Although the lower the hot water temperature is, the stronger the pasteurization effect is, if mixing valve 42, mixing temperature detector 49 or flow control valve 48 or the like is out of order, there are hazardous possibility that hot water directly spouts towards human body and makes instantaneous burn.

An effective sterilization effect is obtained by keeping the temperature of the hot water tank 39 to 55–70 degrees centigrade and setting the control temperature by mixing valve 42 to 55–70 degrees centigrade by pasteurization control means 34 like the fourth exemplary embodiment of the present invention and moreover instantaneous burn can be avoided even if mixing valve 42 and flow control valve 48 are out of order and only the hot water in hot water tank 39 is spouted to the human body.

A similar effect can be obtained also using hot water of 55–70 degrees centigrade in the first exemplary embodiment and using hot air of 55–70 degrees centigrade in the second exemplary embodiment.

(Fifth exemplary embodiment)

Figure 4:
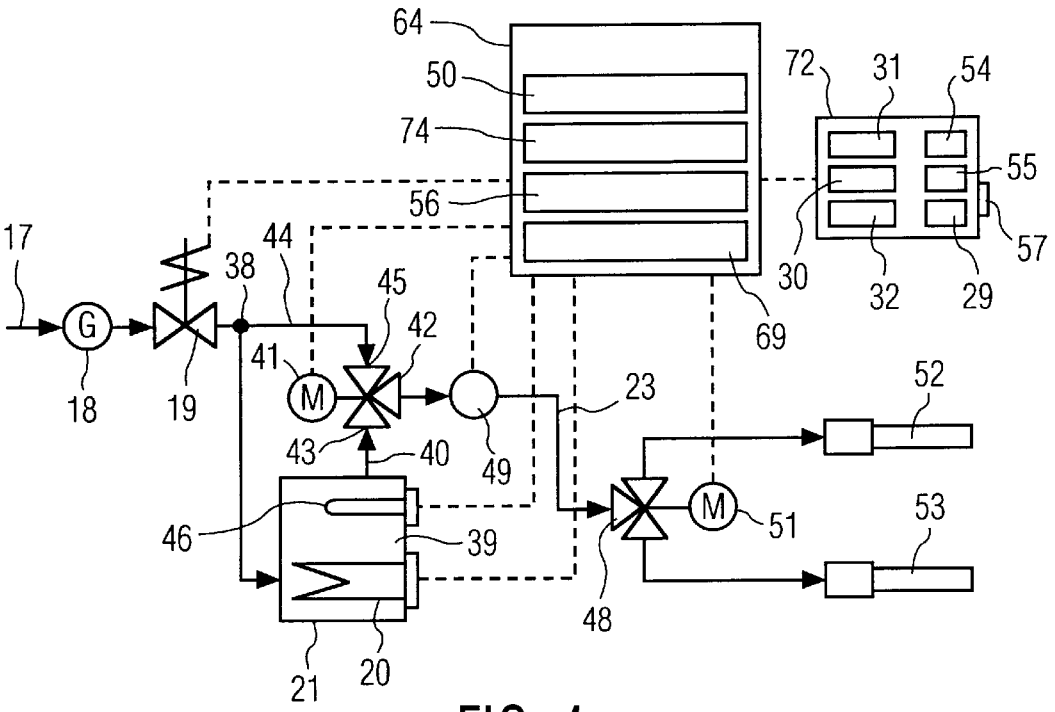
FIG. 4 is a block diagram of a warm water washing device in accordance with a fifth exemplary embodiment of the present invention.

FIG. 4 is a block diagram of a warm water washing device in accordance with a fifth exemplary embodiment of the present invention.

The different point from the third exemplary embodiment is that an automatic pasteurization timer means 56 which makes pasteurization control means 74 work at every designated period is provided in a controller and the reference number of the controller is changed from 63 to 64.

According to the fifth exemplary embodiment of the present invention, when an automatic sterilization switch 57 on setting button unit 72 is turned on, the water flowing route from hot water course 23 to flow control valve 48 and discharge nozzles 52 and 53 is pasteurized at every designated period (for example, every one hour) and automatically by that automatic sterilization timer means 56 in controller 64 outputs a pasteurization mode signal to pasteurization control means 74. As a result, pollution by fungi and molds does not outbreak and the device can be always kept hygienic and clean.

Also in the first and second exemplary embodiments, a similar effect can be obtained by providing with automatic sterilization timer means 56 and automatically pasteurizing.

(Sixth exemplary embodiment)

Figure 5:
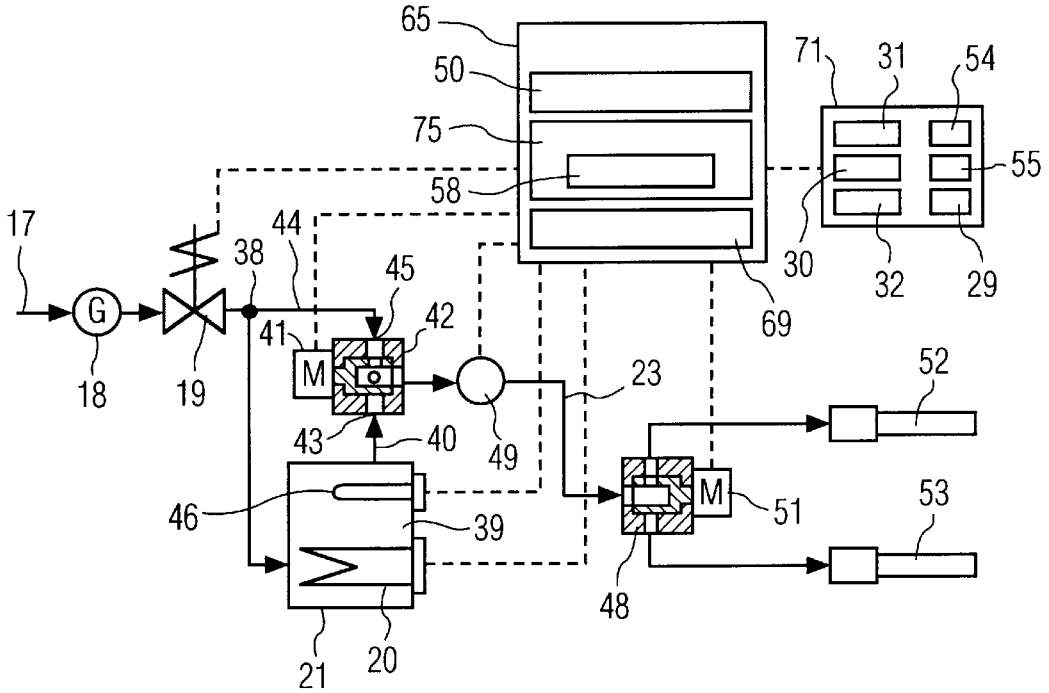
FIG. 5 is a block diagram of a warm water washing device in accordance with a sixth exemplary embodiment of the present invention.

FIG. 5 is a block diagram of a warm water washing device in accordance with a sixth exemplary embodiment of the present invention.

The different point from the third exemplary embodiment is that a flow control means 58 is provided in pasteurization control means 75 in controller 65. The jet stream from discharge nozzles 52 and 53 are limited not to reach a human body by the flow control means 58.

According to the sixth exemplary embodiment of the present invention, because the flow rate is limited by flow control valve 48 so that a hot water jet stream from discharge nozzle 52 and 53 does not reach the human body by flow rate limit means 58, there is no worry that the user feels too hot or unpleasant and suffers burns even if pasteurization switch 32 is pushed by mistake at washing. Thus, a safe and hygienic warm water washing device can be presented.

Also in the first and second exemplary embodiments, a similar effect can be obtained by limiting the flow rate so that hot water or hot air does no hit the human body.

(Seventh exemplary embodiment)

Figure 6:
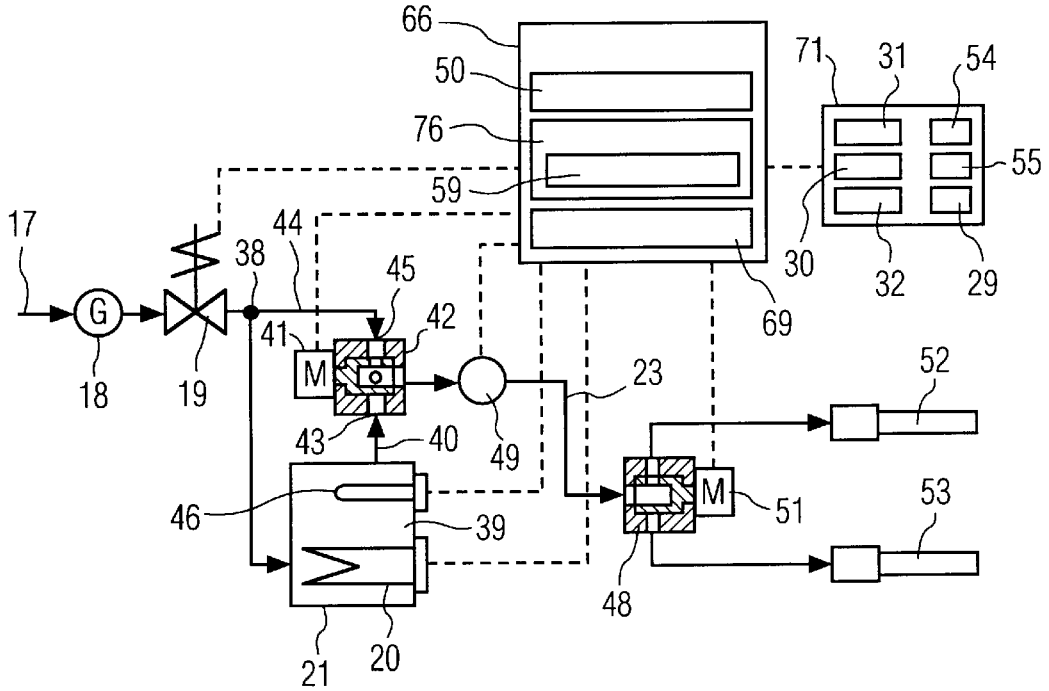
FIG. 6 is a block diagram of a warm water washing device in accordance with a seventh exemplary embodiment of the present invention.

FIG. 6 is a block diagram of a warm water washing device in accordance with a seventh exemplary embodiment of the present invention.

The different point from the third exemplary embodiment is that safety temperature ending means 59 is provided in pasteurization control means 76 in controller 66. The safety temperature ending means 59 detects that the temperature detected by mixing temperature detector 49 became a safety temperature at the end of a pasteurization mode and makes valve 19 closed after a designated period.

According to the seventh exemplary embodiment of the present invention, because safety temperature ending means 59 works not to wash the human body just after the pasteurization mode operates, a warm water washing device which is safe and hygienic and has no worry to discharge hot water from discharge nozzles can be presented.

Also in the first and second exemplary embodiments, a similar effect can be obtained if the device is made so that the body washing is not made until the hot water or the hot air cools down to a safe temperature.

(Eighth exemplary embodiment)

Figure 7:
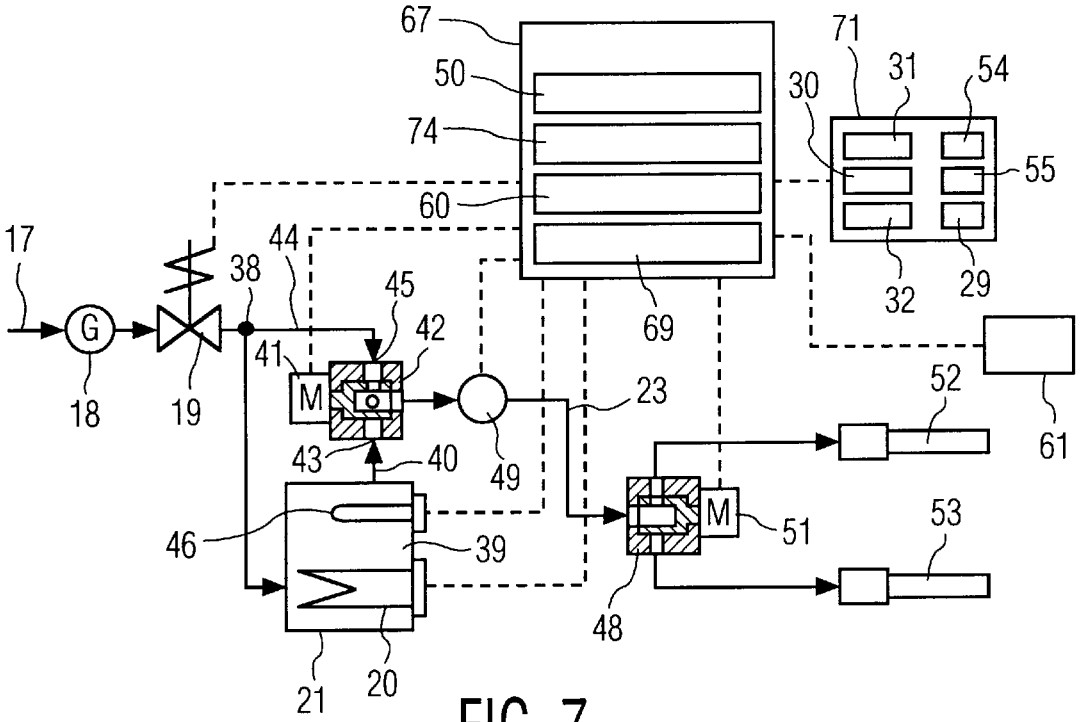
FIG. 7 is a block diagram of a warm water washing device in accordance with an eighth exemplary embodiment of the present invention.
Figure 8:
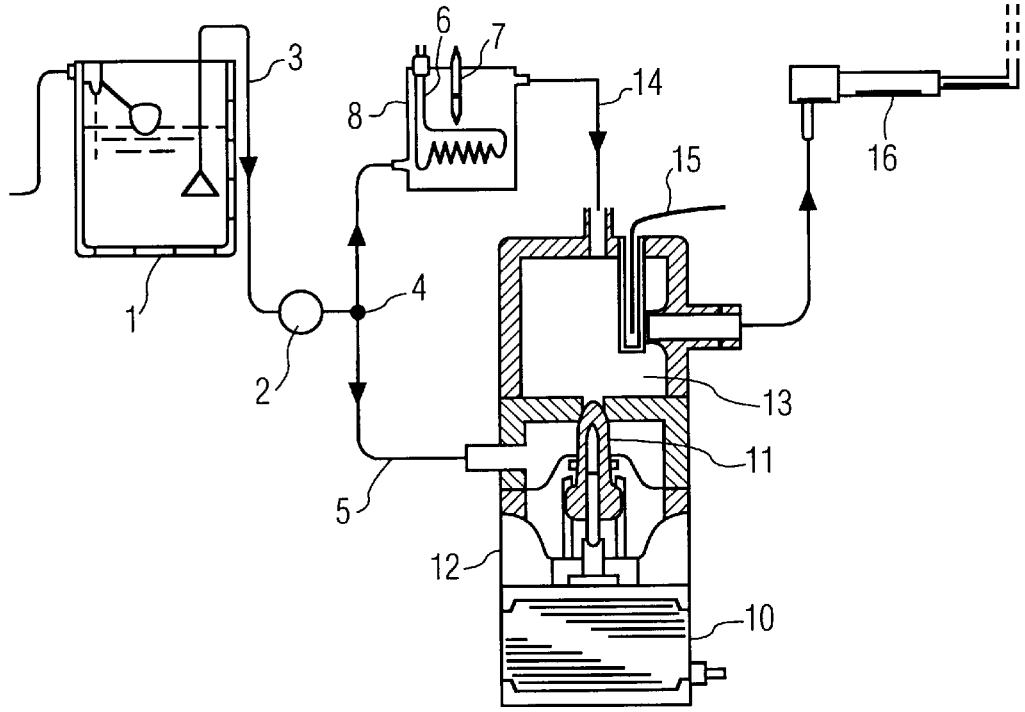
FIG. 8 PRIOR ART
FIG. 8 is a block diagram of a warm water washing device in accordance with the prior art.

FIG. 7 is a block diagram of a warm water washing device in accordance with a eighth exemplary embodiment of the present invention.

The different point from the third exemplary embodiment is that body detection means 61 detecting an existence of a body (for example, a detecting device using infrared rays or the like) is provided so as to be connected with controller 67 and pasteurization control means 74 is made to prohibit the pasteurization when body detection means 61 is detecting the body.

According to the eighth exemplary embodiment of the present invention, because the pasteurization is stopped while body detection means 61 detects a body, a warm water washing device which is safe and hygienic and has no worry to discharge hot water to the body can be presented.

Also in the first and second exemplary embodiments, a similar effect can be obtained if body detection means 61 is provided and pasteurization is prohibited while a body is detected.

In the third to the eighth exemplary embodiments, a method to heat the water in hot water tank 39 by heater 20 is adopted but it may be an instantaneous boiler or a method to combine a small hot water tank and an instantaneous boiler.

Flow control valve 25 or 48 may be provided on the way of feed pipe 17 or a method just to supply and stop hot water.

Further, mixing valve 42 may locate at branch point 38 side or may be a construction to adjust only one side or both side of hot water. The device described every exemplary embodiment is not restricted to a hygienic washing toilet seat device but a similar effect can be obtained in a shower device to wash a human body.

AVAILABILITY ON THE INDUSTRY

According to the first invention, because the inside of the water flowing route which is difficult to clean is pasteurized, pollution due to fungi such as colon bacillus and Salmonella and molds having a little resistance to heat does not outbreak and the device can be kept hygienic.

According to the second invention, in the first exemplary embodiment, because pasteurization control means for controlling pasteurization by receiving a pasteurization mode signal is provided, the inside of the water flowing route which is difficult to clean is pasteurized without complicated handling and pollution due to fungi and molds does not outbreak and the device can be kept hygienic.

According to the third invention, in the first or the second exemplary embodiment, pollution due to fungi and molds does not outbreak and the device can be kept hygienic by pasteurizing using hot air.

According to the fourth invention, in the first or the second exemplary embodiment, pollution due to fungi and molds does not outbreak and the device can be kept hygienic by pasteurizing using hot water.

According to the fifth invention, the inside of the water flowing route which is difficult to clean is pasteurized and pollution due to fungi and molds does not outbreak and the device can be kept hygienic.

According to the sixth invention, the inside of the water flowing route which is difficult to clean is pasteurized and pollution due to fungi and molds does not outbreak and the device can be kept hygienic.

According to the seventh invention, because the hot water temperature is set at 55–70 degrees centigrade, there is no worry of instantaneous burn even if the hot water touches the human body and pollution due to fungi and molds can be effectively prevented.

According to the eighth invention, because the inside of the water flowing route is pasteurized automatically and at every designated period, pollution due to fungi and molds does not outbreak and the device can always be kept hygienic and clean.

According to the ninth invention, by controlling the flow rate so that the jet stream from the discharge nozzles does not hit the human body, the water flowing route can be kept clean without giving too hot and unpleasant feelings or burns to the user whenever pasteurization is made.

According to the tenth invention, because the discharge quantity is limited so that the jet stream from the discharge nozzle does no reach the human body, the water flowing route can be kept clean without giving too hot and unpleasant feelings or burns to the user whenever pasteurization is made.

According to the eleventh invention, because the body washing is not done just after pasteurization works, there is no worry that hot water spouts from the discharge nozzle to the human body and a safe warm water washing device can be presented According to the twelfth invention, because pasteurization is stopped while body detection means is detecting the human body, a safe warm water washing device having no worry to spout hot water to the human body can be presented.

Notations:

1 . . . feedwater tank
2 . . . feed pump
3 . . . feed pipe
4 . . . branch point
5 . . . bypass pipe
6 . . . heater
7 . . . tank temperature detector
8 . . . hot water tank
10 . . . stepping motor
11 . . . valve
12 . . . mixing device
13 . . . mixing chamber
14 . . . hot water feed pipe
15 . . . temperature detector
16 . . . nozzle
17 . . . feed pipe
18 . . . decompression means
19 . . . valve
20 . . . heater
21 . . . heating means
22 . . . discharge nozzle
23 . . . hot water course
24 . . . temperature detector
25 . . . flow control valve
26, 68, 69 . . . heating temperature control means
27, 70, 71, 72 . . . setting buttin unit
28 . . . washing switch
29 . . . sropping switch
30 . . . temperature setting switch
31 . . . flow rate setting switch
32 . . . pasteurization switch
33, 62, 63, 64, 65, 66, 67 . . . controller
34, 73, 74, 75, 76 . . . pasteurization control means
35 . . . compression means
36 . . . air heating means
37 . . . drying switch
38 . . . branch point
39 . . . hot water tank
40 . . . hot water outgoing pipe
41 . . . electric drive means
42 . . . mixing valve
43 . . . hot water inlet
44 . . . bypass pipe
45 . . . water inlet
46 . . . hot water temperature detector
48 . . . flow control valve
49 . . . mixing temperature detector
50 . . . mixing temperature control means
51 . . . electric drive means
52 . . . discharge nozzle
53 . . . discharge nozzle
54 . . . anal washing switch
55 . . . bidet switch
56 . . . automatic sterilization timer means
57 . . . automatic sterilization switch
58 . . . flow rate limit means
59 . . . safety temperature ending means
60 . . . pasteurization prohibition means
61 . . . body detection means

What is claimed:

1. A warm water washing device comprising:

a discharge nozzle for discharging warm water;

a flow control valve provided in a hot water course which precedes said discharge nozzle, said flow control valve being driven electrically;

pasteurization means for pasteurizing said discharge nozzle and at least a part of said hot water course;

pasteurization control means for controlling said pasteurization means, for receiving a pasteurization node signal, and for controlling said flow control valve to reduce a flow rate; and valve means, responsive to said pasteurization control means and coupled to control a flow rate of water through the hot water course, wherein the valve means is configured to reduce the flow rate of the hot water during the pasteurization.

2. A warm water washing device as recited in claim 1, wherein:

pasteurization means pasteurizes with hot air.

3. A warm water washing device as recited in claim 1, wherein:

pasteurization means pasteurizes with hot water.

4. A warm water washing device comprising:

heating means;

feed pipe connected to said heating means;

a mixing valve for controlling a mixing ratio of water from said feed pipe and hot water heated by said heating means;

a discharge nozzle connected to said mixing valve; and pasteurization control means for controlling pasteurization of said discharge nozzle and a hot water course to said discharge nozzle by hot water from said mixing valve.

5. A warm water washing device comprising:

heating means;

hot water temperature detector for detecting a temperature of hot water heated by said heating means;

heating temperature control means for controlling the temperature of hot water heated by said heating means;

a feed pipe connected to said heating means;

a bypass pipe branching off from said feed pipe and not passing through said heating means;

a mixing valve providing with electric drive means for controlling a mixing ratio of the water from said bypass pipe and the hot water heated by said heating means;

a hot water pipe which a hot water outgoing pipe connected to said heating means and bypass pipe join;

a discharge nozzle connected to said hot water pipe;

a mixing temperature detector for detecting a temperature of hot water at down stream of said mixing valve;

a setting button unit for setting a temperature of the hot water flowing in said hot water pipe;

mixing temperature control means for comparing the temperature detected by said mixing temperature detector with the temperature set by said setting button unit and controlling said mixing valve; and pasteurization control means for controlling pasteurization of said discharge nozzle and the hot water course to said discharge nozzle by hot water according to a pasteurization mode signal.

6. A warm water washing device in accordance with claim 1, wherein the temperature for pasteurization is set to 55–70 degrees centigrade.

7. A warm water washing device in accordance with claim 2, wherein the temperature for pasteurization is set to 55–70 degrees centigrade.

8. A warm water washing device in accordance with claim 3, wherein the temperature for pasteurization is set to 55–70 degrees centigrade.

9. A warm water washing device in accordance with claim 4, wherein the temperature for pasteurization is set to 55–70 degrees centigrade.

10. A warm water washing device in accordance with claim 5, wherein the temperature for pasteurization is set to 55–70 degrees centigrade.

11. A warm water washing device in accordance with claim 1, wherein the pasteurization is done automatically and at every designated period.

12. A warm water washing device in accordance with claim 2, wherein the pasteurization is done automatically and at every designated period.

13. A warm water washing device in accordance with claim 3, wherein the pasteurization is done automatically and at every designated period.

14. A warm water washing device in accordance with claim 4, wherein the pasteurization is done automatically and at every designated period.

15. A warm water washing device in accordance with claim 5, wherein the pasteurization is done automatically and at every designated period.

16. A warm water washing device in accordance with claim 1, wherein the flow rate is controlled so that the jet stream from said discharge nozzle at pasteurization does not hit a human body.

17. A warm water washing device in accordance with claim 2, wherein the flow rate is controlled so that the jet stream from said discharge nozzle at pasteurization does not hit a human body.

18. A warm water washing device in accordance with claim 3, wherein the flow rate is controlled so that the jet stream from said discharge nozzle at pasteurization does not hit a human body.

19. A warm water washing device in accordance with claim 4, wherein the flow rate is controlled so that the jet stream from said discharge nozzle at pasteurization does not hit a human body.

20. A warm water washing device in accordance with claim 5, wherein the flow rate is controlled so that the jet stream from said discharge nozzle at pasteurization does not hit a human body.

21. A warm water washing device in accordance with claim 1, further comprising:

flow rate limit means for limiting a discharge quantity so that the jet stream from said discharge nozzle at pasteurization does not hit a human body.

22. A warm water washing device in accordance with claim 2, further comprising:

flow rate limit means for limiting a discharge quantity so that the jet stream from said discharge nozzle at pasteurization does not hit a human body.

23. A warm water washing device in accordance with claim 3, further comprising:

flow rate limit means for limiting a discharge quantity so that the jet stream from said discharge nozzle at pasteurization does not hit a human body.

24. A warm water washing device in accordance with claim 4, further comprising:

flow rate limit means for limiting a discharge quantity so that the jet stream from said discharge nozzle at pasteurization does not hit a human body.

25. A warm water washing device in accordance with claim 5, further comprising:

flow rate limit means for limiting a discharge quantity so that the jet stream from said discharge nozzle at pasteurization does not hit a human body.

26. A warm water washing device in accordance with claim 1, further comprising:

safety temperature ending means for ending a pasteurization mode when it is detected that the hot water temperature downs to a safe temperature for a human body after pasteurization and a designated time elapsed.

27. A warm water washing device in accordance with claim 2, further comprising:

safety temperature ending means for ending a pasteurization mode when it is detected that the hot water temperature downs to a safe temperature for a human body after pasteurization and a designated time elapsed.

28. A warm water washing device in accordance with claim 3, further comprising:

safety temperature ending means for ending a pasteurization mode when it is detected that the hot water temperature downs to a safe temperature for a human body after pasteurization and a designated time elapsed.

29. A warm water washing device in accordance with claim 4, further comprising:

safety temperature ending means for ending a pasteurization mode when it is detected that the hot water temperature downs to a safe temperature for a human body after pasteurization and a designated time elapsed.

30. A warm water washing device in accordance with claim 5, further comprising:

safety temperature ending means for ending a pasteurization mode when it is detected that the hot water temperature downs to a safe temperature for a human body after pasteurization and a designated time elapsed.

31. A warm water washing device in accordance with claim 1, further comprising:

human body detection means for detecting an existence of human body; and pasteurization prohibition means for prohibiting pasteurization during said human body detection means detects an existence of human body.

32. A warm water washing device in accordance with claim 2, further comprising:

human body detection means for detecting an existence of human body; and pasteurization prohibition means for prohibiting pasteurization during said human body detection means detects an existence of human body.

33. A warm water washing device in accordance with claim 3, further comprising:

human body detection means for detecting an existence of human body; and pasteurization prohibition means for prohibiting pasteurization during said human body detection means detects an existence of human body.

34. A warm water washing device in accordance with claim 4, further comprising:

human body detection means for detecting an existence of human body; and pasteurization prohibition means for prohibiting pasteurization during said human body detection means detects an existence of human body.

35. A warm water washing device in accordance with claim 5, further comprising:

human body detection means for detecting an existence of human body; and pasteurization prohibition means for prohibiting pasteurization during said human body detection means detects an existence of human body.

36. A warm water washing device as recited in claim 1, wherein said pasteurization means is configured to directly pasteurize said discharge nozzle and said at least part of the hot water course which precedes said discharge nozzle.

37. A warm water washing device as recited in claim 1, wherein said pasteurization means is configured to indirectly pasteurize said discharge nozzle and at least part of the hot water course which precedes said discharge nozzle.

38. A warm water washing device as recited in claim 1, further comprising a heater coupled to said discharge nozzle by the hot water course, and wherein said pasteurization means is configured to pasteurize the hot water course between said heater and said discharge nozzle.

39. A warm water washing device as recited in claim 1, wherein said pasteurization means is configured to pasteurize said discharge nozzle by admitting hot water to flow through the hot water course and through said discharge nozzle.

* * * * *

UNITED STATES PATENT AND TRADE MARK OFFICE

CERTIFICATE OF CORRECTION

PATENT NO. : 5,970,528
DATED : October 26, 1999
INVENTOR(S) : Shirai et al.

It is certified that error appears in the above-identified patent and that said Letters Patent is hereby corrected as shown below:

Column 12, line 47, "node" should be --mode--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*